US010284986B2

(12) United States Patent
Zou et al.

(10) Patent No.: US 10,284,986 B2
(45) Date of Patent: May 7, 2019

(54) PIEZOELECTRIC SPEAKER AND METHOD FOR FORMING THE SAME

(71) Applicant: GOERTEK INC., Weifang, Shandong (CN)

(72) Inventors: Quanbo Zou, Shandong (CN); Zhe Wang, Shandong (CN)

(73) Assignee: GOERTEK INC., Weifang, Shandong (CN)

( * ) Notice: Subject to any disclaimer, the term of this patent is extended or adjusted under 35 U.S.C. 154(b) by 0 days.

(21) Appl. No.: 15/569,078

(22) PCT Filed: Apr. 29, 2015

(86) PCT No.: PCT/CN2015/077765

§ 371 (c)(1),
(2) Date: Oct. 24, 2017

(87) PCT Pub. No.: WO2016/172866

PCT Pub. Date: Nov. 3, 2016

(65) Prior Publication Data

US 2018/0139542 A1 May 17, 2018

(51) Int. Cl.
*H04R 31/00* (2006.01)
*H04R 17/00* (2006.01)
(Continued)

(52) U.S. Cl.
CPC ..... *H04R 31/00* (2013.01); *H04R 7/06* (2013.01); *H04R 17/00* (2013.01); *H04R 17/10* (2013.01);
(Continued)

(58) Field of Classification Search
CPC .... H04R 31/00; H04R 31/003; H04R 31/006; H04R 7/06; H04R 2307/023;
(Continued)

(56) References Cited

U.S. PATENT DOCUMENTS 3,697,790 A * 10/1972 Flint ..... H04R 17/00 310/328
2008/0049955 A1* 2/2008 Fujiwara ..... H04R 31/006 381/190
(Continued)

FOREIGN PATENT DOCUMENTS

CN 101686423 A 3/2010
CN 104811881 A 7/2015
(Continued)

OTHER PUBLICATIONS

International Search Report for PCT/CN2015/077765 , dated Jan. 13, 2016, ISA/CN.

*Primary Examiner* — A. Dexter Tugbang
(74) *Attorney, Agent, or Firm* — Yue (Robert) Xu; Apex Attorneys at Law, LLP

(57) ABSTRACT

A piezoelectric speaker and a method for forming the piezoelectric speaker are provided. The method includes: providing a piezoelectric actuator which includes a piezoelectric layer, a bottom electrode and a top electrode, wherein the bottom electrode and the top electrode are on two opposite surfaces of the piezoelectric layer; providing a speaker frame which includes a base and a bump structure on the base; forming a solder layer on a top surface of the bump structure; and combining the bottom electrode of the piezoelectric actuator with the speaker frame through the solder layer.

22 Claims, 7 Drawing Sheets

(51) Int. Cl.
*H04R 17/10* (2006.01)
*H04R 7/06* (2006.01)

(52) U.S. Cl.
CPC ..... *H04R 31/003* (2013.01); *H04R 31/006* (2013.01); *H04R 2307/023* (2013.01); *H04R 2400/11* (2013.01); *Y10T 29/42* (2015.01); *Y10T 29/49005* (2015.01)

(58) Field of Classification Search
CPC .... H04R 2400/11; H04R 17/00; H04R 17/10; H01R 17/00; H01R 17/10; Y10T 29/42; Y10T 29/49005
See application file for complete search history.

(56) References Cited

U.S. PATENT DOCUMENTS

| | | | | |
|---|---|---|---|---|
| 2009/0154734 | A1 | 6/2009 | Jeong et al. | |
| 2010/0074459 | A1 | 3/2010 | Chung et al. | |
| 2014/0210309 | A1* | 7/2014 | Miyoshi ..... | H04R 31/003 310/313 A |

FOREIGN PATENT DOCUMENTS

| | | | | |
|---|---|---|---|---|
| JP | 02214299 | A | * | 8/1990 |
| KR | 20130127342 | A | | 11/2013 |

* cited by examiner

PIEZOELECTRIC SPEAKER AND METHOD FOR FORMING THE SAME

CROSS-REFERENCE TO RELATED APPLICATIONS

This application is the national phase of International Application No. PCT/CN2015/077765, titled "PIEZOELECTRIC SPEAKER AND METHOD FOR FORMING THE SAME", filed on Apr. 29, 2015, the entire disclosure of which is incorporated herein by reference.

TECHNICAL FIELD

The present disclosure generally relates to acoustoelectric conversion technology, and more particularly, to a piezoelectric speaker and a method for forming the same.

BACKGROUND

As terminals for personal voice communication and data communication are rapidly developed, piezoelectric speakers are developed in recent years. In a piezoelectric speaker, a piezoelectric material is used as an electro-acoustic transducer element. A sound output mechanism of the piezoelectric speaker is that, an application of an AC voltage to two surface of the piezoelectric element causes a generation of shape distortion of the piezoelectric element, so that a metal diaphragm is vibrated, thereby generating a sound.

However, most of conventional piezoelectric speakers are fabricated by MEMS technologies, which results in a complex fabrication process and a high cost.

SUMMARY

In one embodiment, a method for forming a piezoelectric speaker is provided. The method may include: providing a piezoelectric actuator which includes a piezoelectric layer, a bottom electrode and a top electrode, wherein the bottom electrode and the top electrode are on two opposite surfaces of the piezoelectric layer; providing a speaker frame which includes a base and a bump structure on the base; forming a solder layer on a top surface of the bump structure; and combining the bottom electrode of the piezoelectric actuator with the speaker frame through the solder layer.

In some embodiments, the step of providing a piezoelectric actuator includes: providing a piezoelectric substrate, and forming a top electrode on the piezoelectric substrate; providing a supporting substrate, and forming an adhesive layer on the supporting substrate; turning the supporting substrate over, and combining the top electrode with the supporting substrate through the adhesive layer; thinning the piezoelectric substrate to form a piezoelectric layer; and forming a bottom electrode on the piezoelectric layer.

In some embodiments, the method further includes: after combining the bottom electrode of the piezoelectric actuator with the speaker frame through the solder layer, removing the supporting substrate and the adhesive layer.

In some embodiments, the piezoelectric layer includes piezoelectric ceramic, and has a thickness ranging from 3 μm to 50 μm.

In some embodiments, the bottom electrode and the top electrode include Ti, Ag, Cr, Pt or Au, and have a thickness ranging from 0.01 μm to 0.5 μm.

In some embodiments, the method further includes: forming a metal base layer on the top electrode, wherein the metal base layer is combined with the supporting substrate through the adhesive layer; and the metal base layer comprises Ni, Cu or TiW, and has a thickness ranging from 1 μm to 20 μm.

In some embodiments, the base has a bottom venting hole therethrough, and the bump structure surrounds the bottoming venting hole.

In some embodiments, the method further includes: forming a first electrode on a surface of the base opposite to the bump structure, wherein the first electrode is electrically connected with the bottom electrode of the actuator through the bump structure.

In some embodiments, the method further includes: forming a second electrode on a surface of the base opposite to the bump structure; and forming a shell to case the piezoelectric actuator and the speaker frame, wherein the second electrode is electrically connected with the top electrode of the actuator through the shell.

In some embodiments, the piezoelectric actuator covers an entire area surrounded by the bump structure.

In some embodiments, the piezoelectric actuator covers a part of an area surrounded by the bump structure.

In some embodiments, the bump structure surrounds a rectangle area, and two piezoelectric actuators cover two side parts of the rectangle area and expose a middle part.

In some embodiments, the method further includes: forming a diaphragm layer on the piezoelectric actuator, wherein the diaphragm layer and the piezoelectric actuator cover the entire area surrounded by the bump structure.

In one embodiment, a piezoelectric speaker is provided. The piezoelectric speaker may include: a piezoelectric actuator which includes a piezoelectric layer, a bottom electrode and a top electrode, wherein the bottom electrode and the top electrode are on two opposite surfaces of the piezoelectric layer; a speaker frame which includes a base and a bump structure on the base; a solder layer on a top surface of the bump structure, wherein the bottom electrode of the piezoelectric actuator is combined with the speaker frame through the solder layer.

In some embodiments, the piezoelectric layer includes piezoelectric ceramic, and has a thickness ranging from 3 μm to 50 μm.

In some embodiments, the bottom electrode and the top electrode include Ti, Ag, Cr, Pt or Au, and have a thickness ranging from 0.01 μm to 0.5 μm.

In some embodiments, the piezoelectric actuator further includes a metal base layer on the top electrode, and the metal base layer includes Ni, Cu or TiW, and has a thickness ranging from 1 μm to 20 μm.

In some embodiments, the base has a bottom venting hole therethrough, and the bump structure surrounds the bottoming venting hole.

In some embodiments, the piezoelectric speaker further includes: a first electrode disposed on a surface of the base opposite to the bump structure, wherein the first electrode is electrically connected with the bottom electrode of the actuator through the bump structure.

In some embodiments, the piezoelectric speaker further includes: a second electrode disposed on a surface of the base opposite to the bump structure; and a shell casing the piezoelectric actuator and the speaker frame, wherein the second electrode is electrically connected with the top electrode of the actuator through the shell.

In some embodiments, the piezoelectric actuator covers an entire area surrounded by the bump structure.

In some embodiments, the piezoelectric actuator covers a part of an area surrounded by the bump structure.

In some embodiments, the bump structure surrounds a rectangle area, and two piezoelectric actuators cover two side parts of the rectangle area and expose a middle part.

In some embodiments, the piezoelectric speaker further includes: a diaphragm layer on the piezoelectric actuator, wherein the diaphragm layer and the piezoelectric actuator cover the entire area surrounded by the bump structure.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

DETAILED DESCRIPTION

Figure 1:
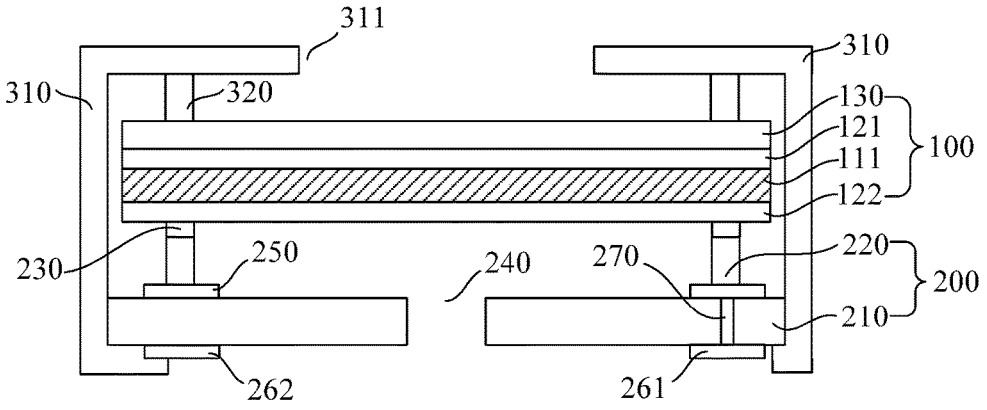
FIG. 1 schematically illustrates a structure diagram of a piezoelectric speaker according to one embodiment.

In the following detailed description, reference is made to the accompanying drawings, which form a part hereof In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the Figures, can be arranged, substituted, combined, and designed in a wide variety of different configurations, all of which are explicitly contemplated and make part of this disclosure.

FIG. 1 is a cross-sectional diagram of a piezoelectric speaker according to one embodiment of the present disclosure.

The piezoelectric speaker shown in FIG. 1 includes: a piezoelectric actuator 100 which includes a piezoelectric layer 111, a bottom electrode 122 and a top electrode 121, where the bottom electrode 122 and the top electrode 121 are on two opposite surfaces of the piezoelectric layer 111; a speaker frame 200 which includes a base 210 and a bump structure 220 on the base; and a solder layer 230 on a top surface of the bump structure 220, wherein the bottom electrode 122 of the piezoelectric actuator 100 is combined with the speaker frame 200 through the solder layer 230.

As shown in FIG. 1, the base 210 of the speaker frame 200 has a bottom venting hole 240 therethrough, and the bump structure 220 is disposed to surround the bottoming venting hole 240. The piezoelectric actuator 100, the bump structure 220 and the base 210 form a back chamber of the piezoelectric speaker. In addition, a first electrode 261 and a second electrode 262 are disposed on a surface of the base 210 opposite to the bump structure 220, and the first electrode can be electrically connected with the bump structure 220 through an interconnection plug 270 and a pad 250. The piezoelectric speaker also includes a shell 310 casing the piezoelectric actuator 100 and the speaker frame 200. The shell 310 has a top venting hole 311 at a surface near the piezoelectric actuator 100. The second electrode 262 is electrically connected with the top electrode 121 through the shell 310. The piezoelectric actuator 100, a supporting structure 320 and the shell 311 form a front chamber of the piezoelectric speaker.

Hereunder, a method for forming the piezoelectric speaker will be described step-by-step.

FIGS. 2-9 are cross-sectional diagrams for describing a process of forming the piezoelectric speaker illustrated in FIG. 1 according to one embodiment.

Figure 2:
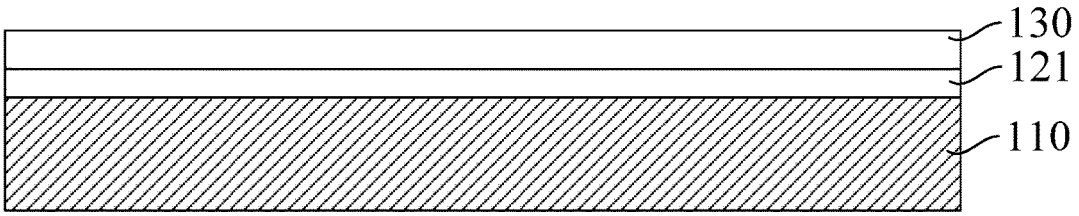
FIGS. 2-9 schematically illustrate intermediate structural diagrams in a method for forming a piezoelectric speaker according to one embodiment.

As shown in FIG. 2, a piezoelectric substrate 110 is provided, a top electrode 121 is formed on the piezoelectric substrate 110, and a metal base layer 130 is formed on the top electrode 121.

The piezoelectric substrate 110 includes piezoelectric material. A mechanical stress can be induced in the piezoelectric material by applying a voltage thereon. In some embodiments, the piezoelectric material may include piezoelectric ceramics, for examples, pbbased lanthanumdoped zirconate titanate (PZT), modified PZT, lead metaniobate, Lead-Barium Metaniobate (PBLN), modified lead titanite, etc. In some embodiments, the piezoelectric may include piezoelectric crystal. However, material of the piezoelectric substrate 110 is not limited thereto, and different materials may be adopted in different applications.

The top electrode 121 is conductive. For example, the top electrode 121 is metal. The top electrode 121 may be formed by a PVD, CVD or plating process. Thickness of the top electrode depends on specific applications of the piezoelectric speaker, and is not limited herein. In some embodiments, the top electrode 121 may include Ti, Ag, Cr, Pt or Au, and have a thickness ranging from 0.01 μm to 0.5 μm.

The metal base layer 130 also can be formed by PVD, CVD or plating. In some embodiments, the metal base layer 130 may be a hard metal for supporting the top electrode 121 and the piezoelectric material, or serving as a diaphragm. In some embodiments, the metal base layer 130 may include Ni, Cu or TiW, and have a thickness ranging from 1 μm to 20 μm.

It should be noted that, in some embodiments, only the top electrode 121 is formed on the piezoelectric substrate 110, and there is no need to form the metal base layer.

Figure 3:
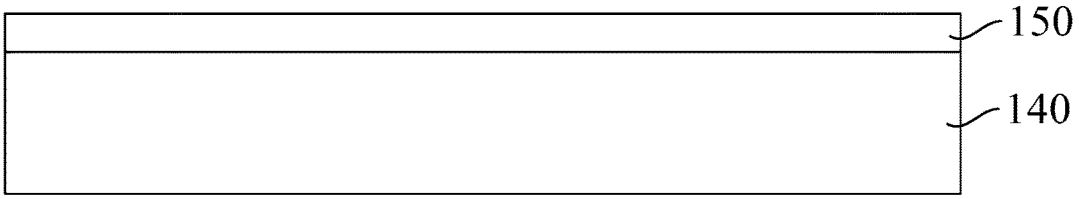

Then, referring to FIG. 3, a supporting substrate 140 is provided, and an adhesive layer 150 is formed on the supporting substrate 140.

The supporting substrate 140 has a flat surface so as to provide mechanical supporting and protection in subsequent processes. In some embodiments, the supporting substrate 140 may be glass, ceramic chips, semiconductor chip, etc.

The adhesive layer 150 may be polymer. The polymer may be selected from conventional adhesive polymers used in semiconductor or machinery area, and is not limited herein. In some embodiments, the adhesive layer 150 may be formed by a deposition process or a coating process, and have a thickness ranging from 1 μm to 20 μm.

Figure 4:
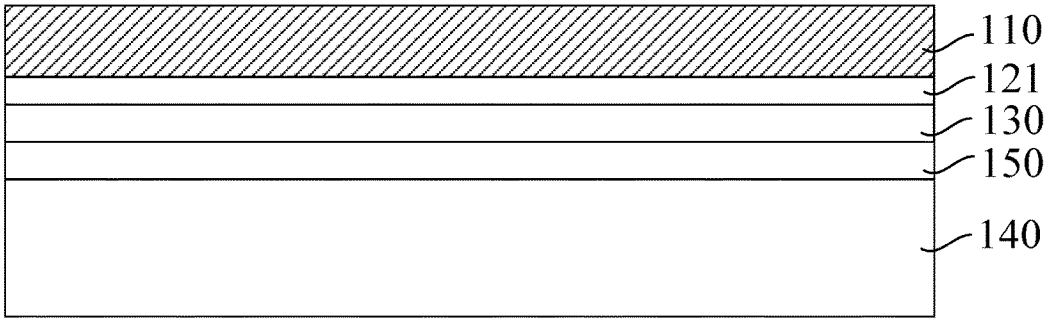

Then, referring to FIG. 4, the piezoelectric substrate 110 is flipped, and the metal base layer 130 is adhered to the supporting substrate 140 through the adhesive layer 150.

Specifically, the metal base layer 130 are attached to the adhesive layer 150, and then UV lights are employed to cure the adhesive layer 150, so that the piezoelectric substrate 110 and the supporting layer 140 can be combined through the adhesive layer 150.

It should be noted that, in other embodiments, the metal base layer 130 or the top electrode 120 can be connected with the supporting substrate 140 by other combination methods, which are not limited herein.

Figure 5:
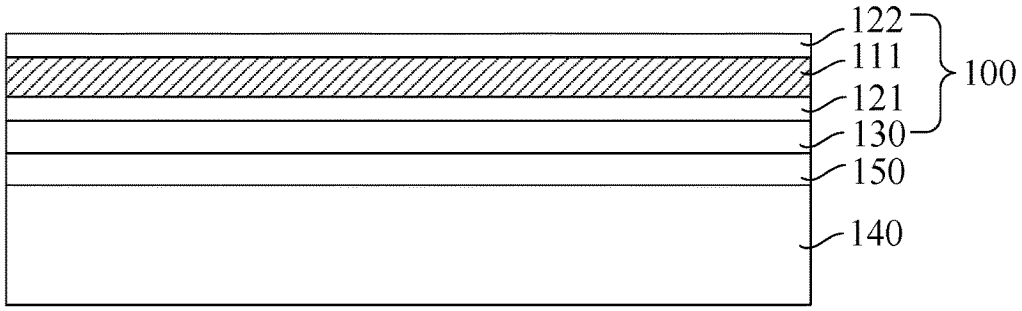

Then, referring to FIG. 4 and FIG. 5, the piezoelectric substrate 110 is thinned to form a piezoelectric layer 111, and a bottom electrode 122 is formed on the piezoelectric layer 111.

Specifically, a grinding process is employed to thin the piezoelectric substrate 110. After the grinding process, the remaining piezoelectric substrate 110 forms the piezoelectric layer 111. In some embodiments, the piezoelectric layer 111 has a thickness ranging from 3 μm to 50 μm. Preferably, the piezoelectric layer 111 has a thickness ranging from 5 μm to 10 μm. The grinding process can control Total Thickness Variation (TTV) of the piezoelectric layer 111 under 1 μm. In some embodiments, in order to obtain a flatter surface or accurately control the thickness of the piezoelectric layer 111, a polishing process may be performed after the grinding process.

Before the thinning process, the piezoelectric substrate 110 has been combined with the supporting substrate 140 through the adhesive layer 150, so that the supporting substrate 140 can provide mechanical support and protection for the piezoelectric substrate 110 in the grinding process. Therefore, a damage of the piezoelectric substrate 110 is avoided.

The bottom electrode 122 can be formed on the piezoelectric layer 111 by a PVD, CVD or plating process. The bottom electrode 122 is conductive. The bottom electrode 122 and the top electrode 121 may include same or different materials. In some embodiments, the bottom electrode 122 may include Ti, Ag, Cr, Pt or Au, and have a thickness ranging from 0.01 μm to 0.5 μm.

In some embodiments, the bottom electrode 122, the piezoelectric layer 111, top electrode 121 and the metal base layer 130 together constitute a piezoelectric actuator 100. When audio voltages are applied on the bottom electrode 122 and the top electrode 121, a corresponding extension or contraction may be produced in the piezoelectric layer 111 to push the metal base layer 130 and air, so as to generate a sound. In other embodiments, the piezoelectric actuator 100 doesn't include the metal base layer 130.

In a specific application, a piezoelectric actuator structure having a large area can be manufactured on a supporting substrate by the above steps. Then, the piezoelectric actuator structure is diced according to dimensions of piezoelectric speaker to be formed, so that a plurality of piezoelectric actuators can be manufactured simultaneously, and manufacturing efficiency is improved.

Figure 6:
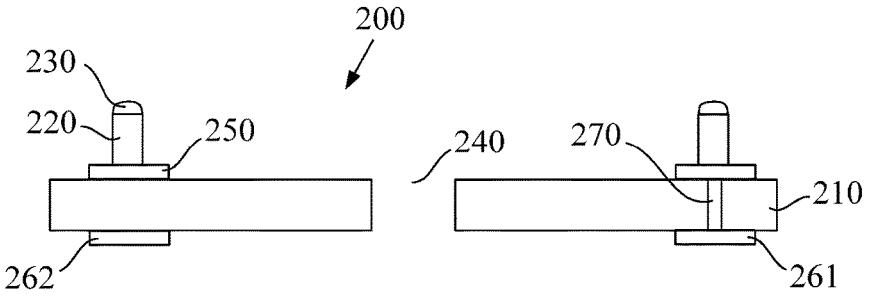

Referring to FIG. 6, a speaker frame 200 is provided. The speaker frame 200 includes a base 210 and a bump structure 220 on the base 210. Then, a solder layer 230 is formed on the bump structure 220.

Specifically, the base 210 may be a PCB, a semiconductor substrate or an insulator substrate. The bump structure 220 on the base 210 is conductive. For example, the bump structure 220 is metal. The base 210 has a bottom venting hole 240 therethrough, and the bump structure 220 surrounds the bottoming venting hole 240. In some embodiments, the bump structure 220 surrounding the bottoming venting hole 240 forms a rectangle ring, a circular ring or a closed ring having other shapes. A first electrode 261 and a second electrode 262 are disposed on a surface of the base 210 opposite to the bump structure 220. The first electrode 261 and the bump structure 220 are electrically connected.

In some embodiments, a pad 250 is formed on a surface of the base 210, and the bump structure 220 is on the pad 250. An interconnection plug 270 is formed in the base 210, and the first electrode 261 is electrically connected with the bump structure 220 through the interconnection plug 270 and the pad 250. After the piezoelectric actuator 100 is connected with the speaker frame 200 in subsequent steps, the first electrode 261 can be electrically connected with the bottom electrode 122 of piezoelectric actuator 100 the through the bump structure 220.

Figure 10:
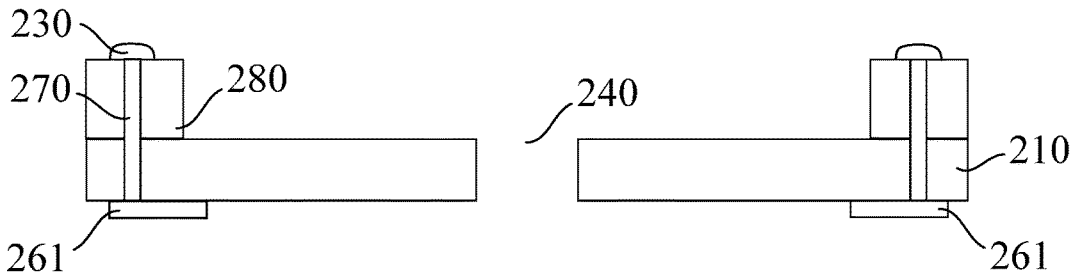
FIG. 10 schematically illustrates a structure diagram of a speaker frame according to one embodiment.

In another embodiment, as shown in FIG. 10, the base 210 of the speaker frame has a sidewall structure 280 thereon, and the sidewall structure 280 forms a cavity. The solder 230 is formed on the sidewall structure 280, and an interconnection plug 270 through the sidewall structure 280 and the base 210 connects the solder 230 with the first electrode 261.

Figure 11:
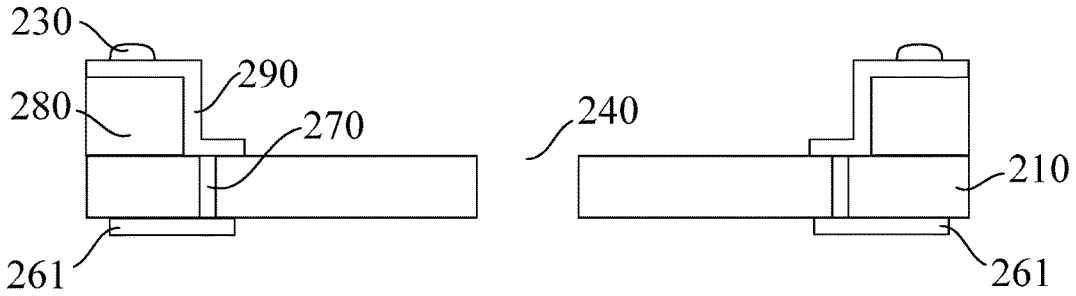
FIG. 11 schematically illustrates a structure diagram of a speaker frame according to another embodiment.

In another embodiment, as shown in FIG. 11, the base 210 of the speaker frame has a sidewall structure 280 thereon, and the sidewall structure 280 forms a cavity. An interconnection metal layer 290 is formed along surfaces of the sidewall structure 280 and the base 210. The solder 230 is formed on the interconnection metal layer 290. An interconnection plug 270 through the base 210 connects the interconnection metal layer 290 with the first electrode 261.

It should be noted that, in FIG. 10 and FIG. 11, there are two first electrodes 261, and the second electrode for connecting the top electrode is not shown.

Figure 7:
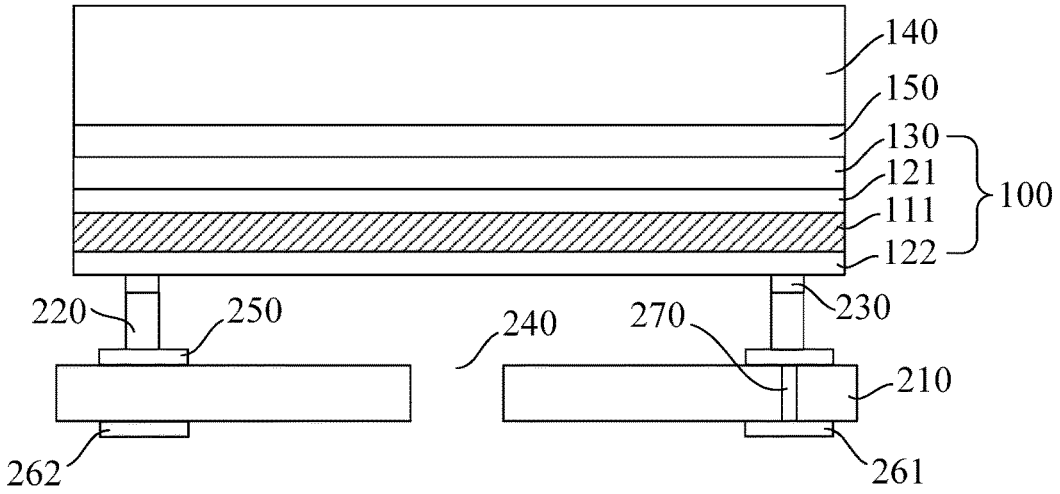

Referring to FIG. 7, the bottom electrode 122 of the piezoelectric actuator 100 is connected to the speaker frame through the solder layer 230.

Specifically, after the solder layer 230 is formed on the top surface of the bump structure 230, the piezoelectric actuator 100 is turn over so that the bottom electrode 122 of the piezoelectric actuator 100 can contact the solder. Then a reflow process is performed to combine the bottom electrode 122 of the piezoelectric actuator 100 and the speaker frame.

In some embodiments, the piezoelectric actuator 100 covers an entire area surrounded by the bump structure 220. As shown in FIG. 7, the piezoelectric actuator 100 covers the entire area surrounded by the bump structure 220. In this case, the piezoelectric actuator 100, the bump structure 220 and the base 210 form a back chamber of the piezoelectric speaker. In a vibration process of the piezoelectric layer 111, air in the back chamber is pushed to vibrate, a sound is generated and radiates from the bottom venting hole 240 in the base 210.

Figure 12:
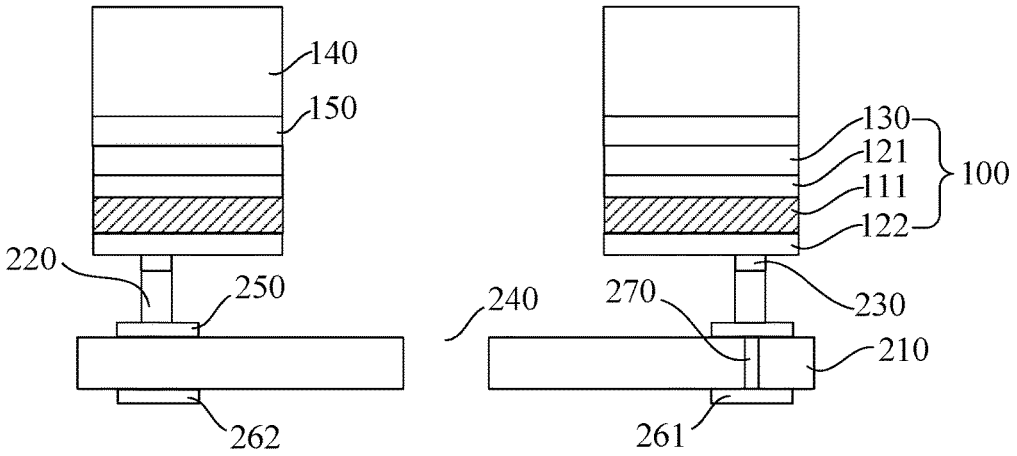
FIGS. 12-15 schematically illustrate intermediate structural diagrams of a method for forming a piezoelectric speaker according to another embodiment.
Figure 13:
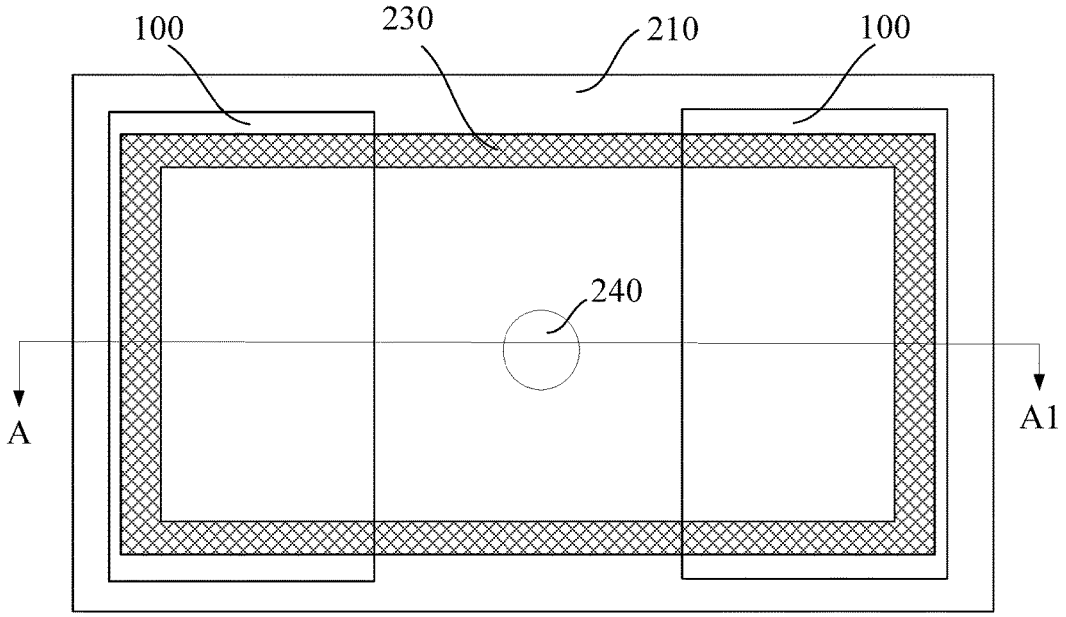

In other embodiments, the piezoelectric actuator only covers a part of an area surrounded by the bump structure. Referring to FIG. 12 and FIG. 13, FIG. 12 is a cross sectional view of FIG. 13 along AA1, and some elements are omitted in FIG. 13 for clarity. The piezoelectric actuator 100 only covers a part of the area surrounded by the bump structure 220. For example, there are two piezoelectric actuators 100 in FIG. 12, and the bump structure 220 surrounds a rectangle area. The two piezoelectric actuators 100 cover two side parts of the rectangle area, and expose a middle part. In other embodiments, more or less piezoelectric actuators cover a part of an area surrounded by the bump structure, and the number of the piezoelectric actuators is not limited herein.

Figure 14:
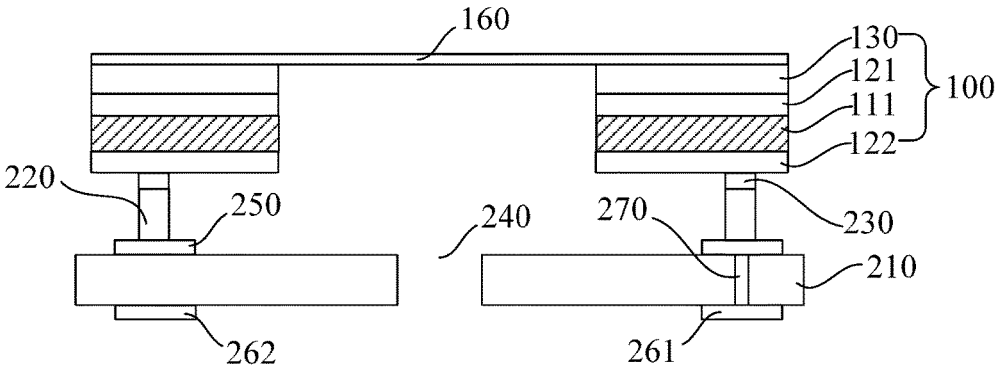

It should be noted that, as shown in FIG. 14, when the piezoelectric actuators only covers a part of an area surrounded by the bump structure 220, a diaphragm layer 160 may be formed on the piezoelectric actuators. The diaphragm layer 160 and the piezoelectric actuators cover the entire area surrounded by the bump structure 220. In this case, the piezoelectric actuator 100, the diaphragm layer 160, the bump structure 220 and the base 210 form a back chamber of the piezoelectric speaker. In a vibration process of the piezoelectric layer 111, the diaphragm layer 160 and air in the back chamber is pushed to vibrate, a sound is generated and radiates from the back venting hole 240 in the base 210.

Figure 8:
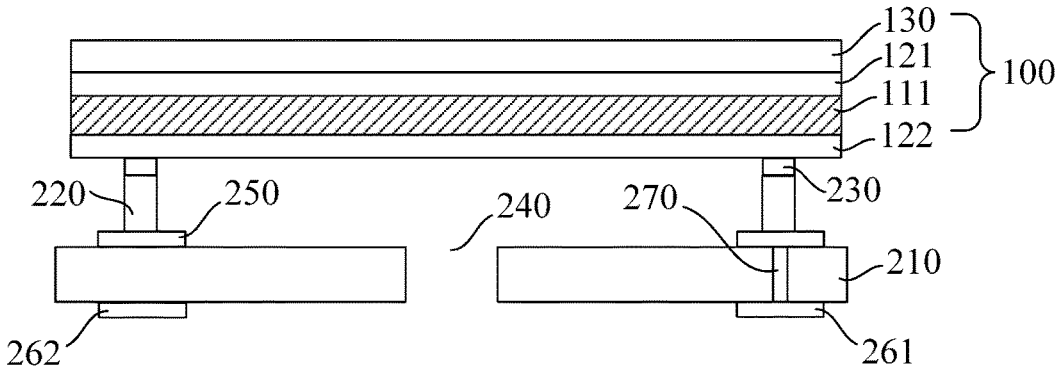

Then, referring to FIG. 8, the supporting substrate 140 and the adhesive layer 150 are removed.

Specifically, the supporting substrate is exposed under an IR laser, so that the polymer of the adhesive layer 150 degenerates. Then, the supporting substrate 140 can be lifted off from the metal base layer 130. Subsequently, remaining adhesive layer 150 is also removed from the metal base layer 130. In some embodiments, a plasma ashing process is further performed to remove the remaining adhesive layer 150.

Figure 9:
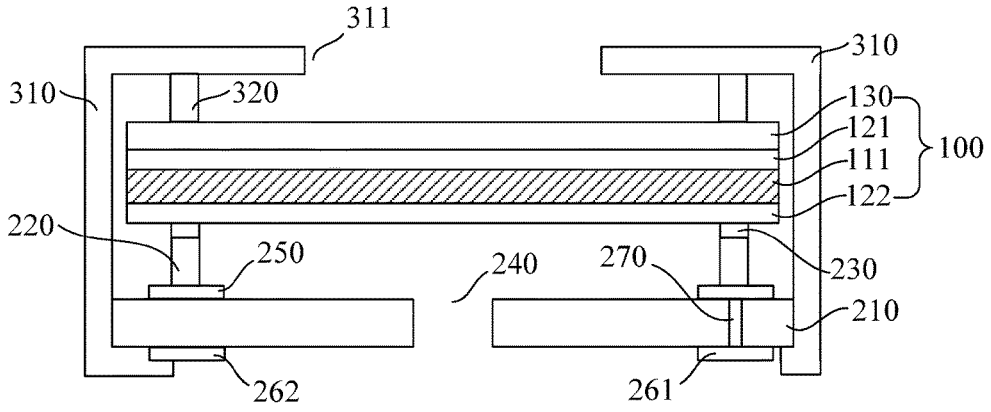

Then, referring to FIG. 9, a shell 310 is formed to case the piezoelectric actuator 100 and the speaker frame 200. The shell 310 has a top venting hole 311 at a surface near the piezoelectric actuator 100. The second electrode 262 is electrically connected with the top electrode 121 through the shell 310.

As shown in FIG. 9, in some embodiments, before the shell 310 is formed, a supporting structure 320 is formed on the piezoelectric actuator 100. The supporting structure 320 supports the shell 310, and the top venting hole 311 is formed at a surface of the shell 310 near the piezoelectric actuator 100. In this case, the piezoelectric actuator 100, the supporting structure 320 and the shell 311 form a front chamber of the piezoelectric speaker. In a vibration process of the piezoelectric layer 111, air in the front chamber is pushed to vibrate, a sound is generated and radiates from the top venting hole 311 of the shell 310.

In some embodiments, the shell 310 and the supporting structure 320 are conductive, for example, conductive metals. The second electrode 262 contacts the shell 310, and is electrically connected with the top electrode 121 through the shell 310, the supporting structure 320 and the metal base layer 130.

In subsequent steps, the piezoelectric speaker can be mounted on an electronic product through the first electrode 261 and the second electrode 262. The first electrode 261 and the second electrode 262 receive acoustic electrical signals. Then, the acoustic electrical signals are transmitted to the bottom electrode 122 and the top electrode 121 of the piezoelectric actuator 100, so that the piezoelectric layer 111 vibrates, and a sound is generated.

Figure 15:
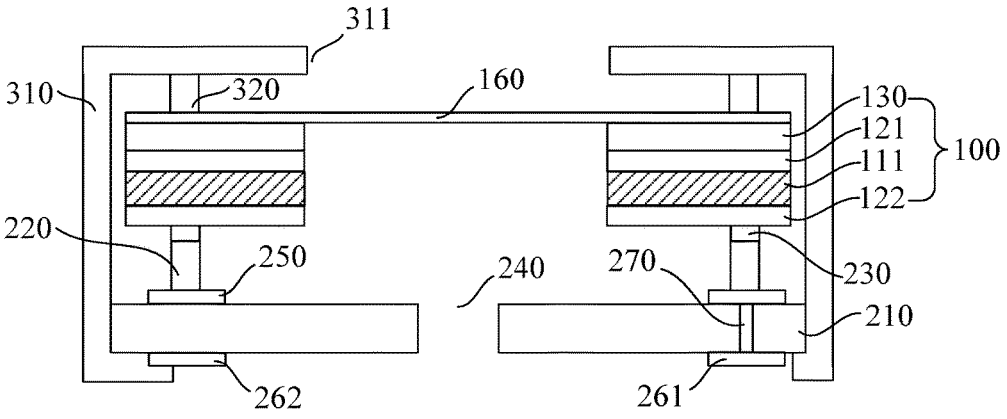

In other embodiments, referring to FIG. 15, a piezoelectric speaker formed by casing the piezoelectric actuator 100 and the speaker frame shown in FIG. 14 with a shell 310 is illustrated. The piezoelectric actuator 100, the diaphragm layer 160, the supporting structure 320 and the shell 311 form a front chamber of the piezoelectric speaker. In a vibration process of the piezoelectric layer 111, the diaphragm layer 160 and air in the front chamber are pushed to vibrate, a sound is generated and radiates from the top venting hole 311 of the shell 310.

Figure 16:
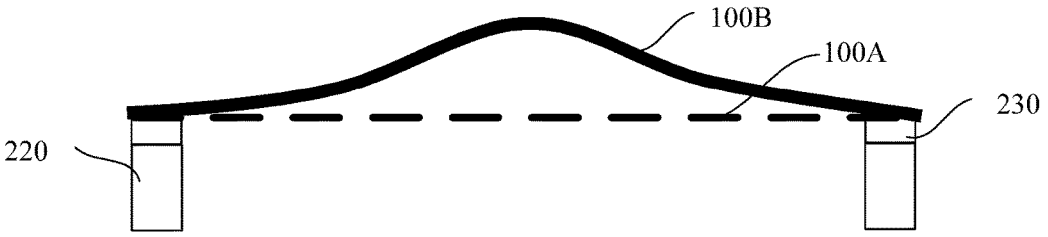
FIG. 16 schematically illustrates a working principle diagram of a piezoelectric actuator according to one embodiment.
Figure 17:
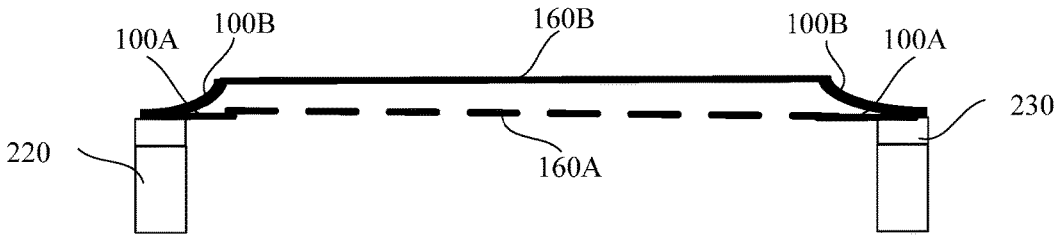
FIG. 17 schematically illustrates a working principle diagram of a piezoelectric actuator according to another embodiment.

Referring to FIGS. 16 and 17, working principles of the piezoelectric actuators 100 of the piezoelectric speakers shown in FIG. 9 and FIG. 15 are respectively illustrated. As shown in FIG. 16, in a case the piezoelectric actuator 100 covers the entire area surrounded by the bump structure 220, when an electrical signal is applied on the piezoelectric actuator 100, a corresponding extension or contraction may be produced in the piezoelectric layer of the piezoelectric actuator 100. The piezoelectric actuator 100 can move upwards from an original position 100A to a new position 100 B (the piezoelectric actuator 100 also can move downwards from the original position 100A, which is not shown herein), so as to push the air in the front chamber or the back chamber and generate a sound.

As shown in FIG. 17, the piezoelectric actuator 100 only covers a part of the area surrounded by the bump structure 220. For example, the two piezoelectric actuators 100 shown in FIG. 17 cover two side parts of the rectangle area surrounded by the bump structure 220, and expose the middle part. In this case, when electrical signals are applied on the two piezoelectric actuators 100, the two piezoelectric actuators 100 may move upwards from original positions 100A to new positions 100 B, so as to push the air in the front chamber or the back chamber and generate a sound. In addition, as shown in FIG. 17, in a vibration process of the piezoelectric actuator 100, the diaphragm layer 160 is also pushed to move from an original position 160A to a new position 160B.

The method according to embodiments of the present disclosure only employs Back-End-of-Line (BEOL) processes to form the piezoelectric speaker. Therefore, cost for fabricating the piezoelectric speaker is reduced.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

We claim:

1. A method for forming a piezoelectric speaker, comprising:

providing a piezoelectric actuator which comprises a piezoelectric layer, a bottom electrode and a top electrode, wherein the bottom electrode and the top electrode are on two opposite surfaces of the piezoelectric layer;

providing a speaker frame which comprises a base and a bump structure on the base, wherein the base has a bottom venting hole through the base, and the bump structure surrounds the bottom venting hole;

forming a solder layer on a top surface of the bump structure; and combining the bottom electrode of the piezoelectric actuator with the speaker frame through the solder layer.

2. The method according to claim 1, wherein providing the piezoelectric actuator comprises:

providing a piezoelectric substrate, and forming the top electrode on the piezoelectric substrate;

providing a supporting substrate, and forming an adhesive layer on the supporting substrate;

turning the supporting substrate over, and combining the top electrode with the supporting substrate through the adhesive layer;

thinning the piezoelectric substrate to form the piezoelectric layer; and forming the bottom electrode on the piezoelectric layer.

3. The method according to claim 2, further comprising: after combining the bottom electrode of the piezoelectric actuator with the speaker frame through the solder layer, removing the supporting substrate and the adhesive layer.

4. The method according to claim 2, further comprising: forming a metal base layer on the top electrode, wherein the metal base layer is combined with the supporting substrate through the adhesive layer; and the metal base layer comprises Ni, Cu or TiW, and has a thickness ranging from 1 μm to 20 μm.

5. The method according to claim 1, wherein the piezoelectric layer comprises piezoelectric ceramic, and has a thickness ranging from 3 μm to 50 μm.

6. The method according to claim 1, wherein the bottom electrode and the top electrode comprise Ti, Ag, Cr, Pt or Au, and have a thickness ranging from 0.01 μm to 0.5 μm.

7. The method according to claim 1, further comprising: forming a first electrode on a surface of the base opposite to the bump structure, wherein the first electrode is electrically connected with the bottom electrode of the actuator through the bump structure.

8. The method according to claim 1, further comprising: forming a second electrode on a surface of the base opposite to the bump structure; and forming a shell to case the piezoelectric actuator and the speaker frame, wherein the second electrode is electrically connected with the top electrode of the actuator through the shell.

9. The method according to claim 1, wherein the piezoelectric actuator covers an entire area surrounded by the bump structure.

10. The method according to claim 1, wherein the piezoelectric actuator covers a part of an area surrounded by the bump structure.

11. The method according to claim 10, wherein the bump structure surrounds a rectangle area, and two of the piezoelectric actuators cover two side parts of the rectangle area and expose a middle part.

12. The method according to claim 10, further comprising: forming a diaphragm layer on the piezoelectric actuator, wherein the diaphragm layer and the piezoelectric actuator cover the area surrounded by the bump structure entirely.

13. A piezoelectric speaker, comprising:

a piezoelectric actuator which comprises a piezoelectric layer, a bottom electrode and a top electrode, wherein the bottom electrode and the top electrode are on two opposite surfaces of the piezoelectric layer;

a speaker frame which comprises a base and a bump structure on the base, wherein the base has a bottom venting hole through the base, and the bump structure surrounds the bottom venting hole; and a solder layer on a top surface of the bump structure, wherein the bottom electrode of the piezoelectric actuator is combined with the speaker frame through the solder layer.

14. The piezoelectric speaker according to claim 13, wherein the piezoelectric layer comprises piezoelectric ceramic, and has a thickness ranging from 3 μm to 50 μm.

15. The piezoelectric speaker according to claim 13, wherein the bottom electrode and the top electrode comprise Ti, Ag, Cr, Pt or Au, and have a thickness ranging from 0.01 μm to 0.5 μm.

16. The piezoelectric speaker according to claim 13, wherein the piezoelectric actuator further comprises a metal base layer on the top electrode, and the metal base layer comprises Ni, Cu or TiW, and has a thickness ranging from 1 μm to 20 μm.

17. The piezoelectric speaker according to claim 13, further comprising: a first electrode disposed on a surface of the base opposite to the bump structure, wherein the first electrode is electrically connected with the bottom electrode of the actuator through the bump structure.

18. The piezoelectric speaker according to claim 13, further comprising: a second electrode disposed on a surface of the base opposite to the bump structure; and a shell casing the piezoelectric actuator and the speaker frame, wherein the second electrode is electrically connected with the top electrode of the actuator through the shell.

19. The piezoelectric speaker according to claim 13, wherein the piezoelectric actuator covers an entire area surrounded by the bump structure.

20. The piezoelectric speaker according to claim 13, wherein the piezoelectric actuator covers a part of an area surrounded by the bump structure.

21. The piezoelectric speaker according to claim 20, wherein the bump structure surrounds a rectangle area, and two of the piezoelectric actuators cover two side parts of the rectangle area and expose a middle part.

22. The piezoelectric speaker according to claim 20, further comprising: a diaphragm layer on the piezoelectric actuator, wherein the diaphragm layer and the piezoelectric actuator cover the area surrounded by the bump structure entirely.

* * * * *